US005142787A

United States Patent [19]

Dadisman

[11] Patent Number: 5,142,787

[45] Date of Patent: Sep. 1, 1992

[54] MEANS AND METHOD FOR DEFINING A LAYOUT

[76] Inventor: Steven R. Dadisman, 8500 Michael Ray Dr., Louisville, Ky. 40219

[21] Appl. No.: 748,463

[22] Filed: Aug. 22, 1991

[51] Int. Cl.[5] ..... B43L 7/027; G01C 15/12

[52] U.S. Cl. ..... 33/1 G; 33/1 LE; 33/474; 33/453; 33/471

[58] Field of Search ..... 33/1 G, 1 LE, 453, 474, 33/478, 465, 471, 413, 759, 756

[56] References Cited

U.S. PATENT DOCUMENTS

| | | | |
|---|---|---|---|
| 1,098,210 | 5/1914 | Anderson | 33/471 |
| 2,586,074 | 2/1952 | Memluck | 33/1 LE |
| 2,934,826 | 5/1960 | Klaum | 33/1 LE |
| 3,061,931 | 11/1962 | Di Stefano | 33/1 LE |
| 3,375,589 | 4/1968 | Dolgorukov | 33/474 |
| 3,823,480 | 7/1974 | Grundman | 33/1 LE |
| 4,095,343 | 6/1978 | McPhail | 33/1 LE |
| 4,575,943 | 3/1986 | Baum, Jr. | 33/453 |
| 4,742,619 | 5/1988 | Swanson | 33/474 |

FOREIGN PATENT DOCUMENTS

| | | | |
|---|---|---|---|
| 929336 | 12/1947 | France | 33/413 |
| 954305 | 12/1949 | France | 33/1 LE |
| 700207 | 11/1953 | United Kingdom | 33/413 |
| 909344 | 10/1962 | United Kingdom | 33/562 |

*Primary Examiner*—Thomas B. Will

*Attorney, Agent, or Firm*—Terry M. Gernstein

[57] ABSTRACT

A layout for a static structure, such as a building or the like, is defined using a plurality of triangles and a plurality of tethering cables. The layout is effected by measuring from a property line for a starting point and for a length of a base line. The triangles and tethering cables are located and connected to define at least one angle, and further angles and lines are measured from this first angle.

8 Claims, 5 Drawing Sheets

MEANS AND METHOD FOR DEFINING A LAYOUT

TECHNICAL FIELD OF THE INVENTION

The present invention relates to the general art of geometric instruments, and to the particular field of using geometric instruments to perform in situ layout for static structures.

BACKGROUND OF THE INVENTION

Nearly all static structures, such as buildings, parking lots, and the like, must be laid out on the building site before actual construction begins. That is, guidelines and the like must be placed on the ground prior to excavating for footings or basements or the like. A static structure layout generally includes defining guidelines on the ground. These guidelines are angled and oriented with respect to each other according to the desired shape of the static structure.

Heretofore, the layout job has required two or more workers. One person marks a beginning point, while the others use various geometric instruments to sight, orient and measure the layout guidelines. This can be a difficult and time-consuming process, especially if the layout is complicated with many angles and lines. Such layout process can thus be costly as well as frustrating for the workers.

Therefore, there is a need for a layout system and method that can be utilized by one person and is easy to effect, yet is accurate and precise, even for complex layouts.

OBJECTS OF THE INVENTION

It is a main object of the present invention to provide a layout system and method for use in laying out static structures.

It is another object of the present invention to provide a layout system and method that can be utilized by one person.

It is another object of the present invention to provide a layout system and method that is easy to administer, yet is accurate and precise, even for complex layouts.

SUMMARY OF THE INVENTION

These, and other, objects are achieved by a layout system and method that uses three identical triangular elements that are tethered together by cables releasably attached to each element. At least two of the cables are equal in length. Each triangular element includes a wall on the perimeter thereof and a planar web spanning the space within the wall. Anchor means and cable attaching means are mounted in the web, and each cable includes male attaching means on either end thereof for releasably attaching the cable to the triangular elements. The triangular elements are located along a baseline, and the tethering cables extended to establish an initial angle. Other measurements and angles are added to this initial line and angle. In this manner, the overall layout is defined from these initial lines and angle. The triangular elements and the tethering cables can be used to establish and define the further lines and angles in the overall layout.

Using the system and method of the present invention, an overall layout can be accurately and precisely defined by one person, even if the overall layout is complex and difficult. The worker simply makes initial measurements, and then applies the system and method of the present invention for the remaining angles and lines of the layout.

BRIEF DESCRIPTION OF THE DRAWING FIGURES

DETAILED DESCRIPTION OF THE PREFERRED EMBODIMENT OF THE INVENTION

Figure 1:
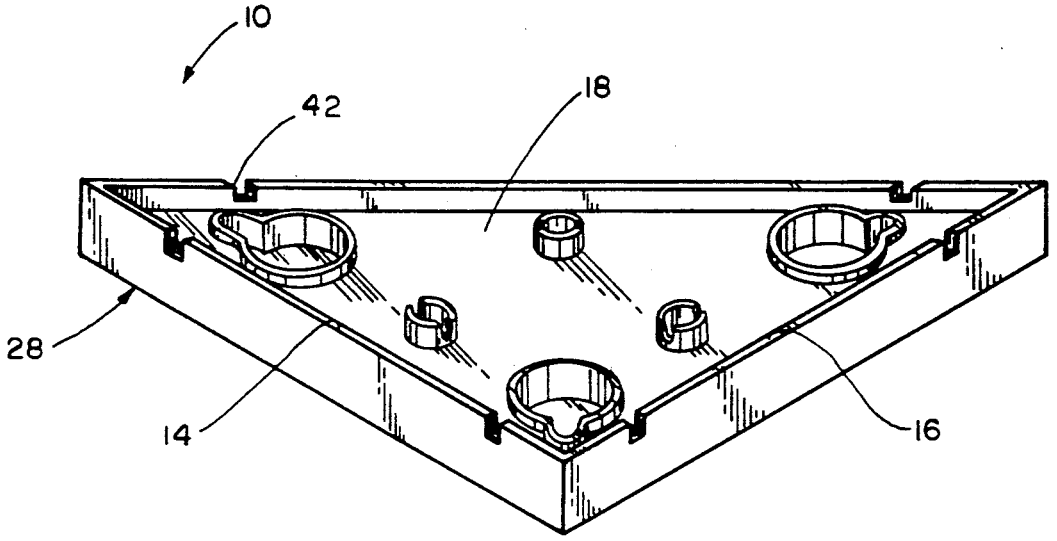
FIG. 1 is a perspective view of a 45° right triangular element used in the system of the present invention.
Figure 2:
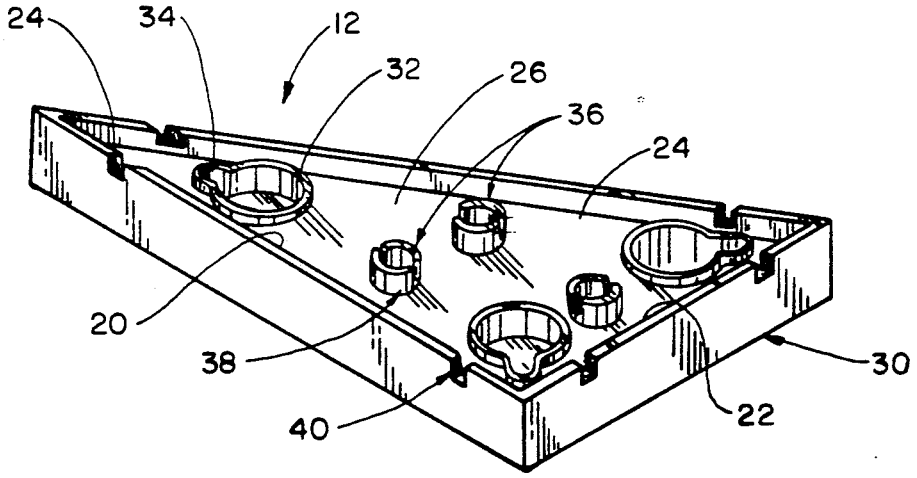
FIG. 2 is a perspective view of a 30°-60°-90° right triangular element used in the system of the present invention.
Figure 3:
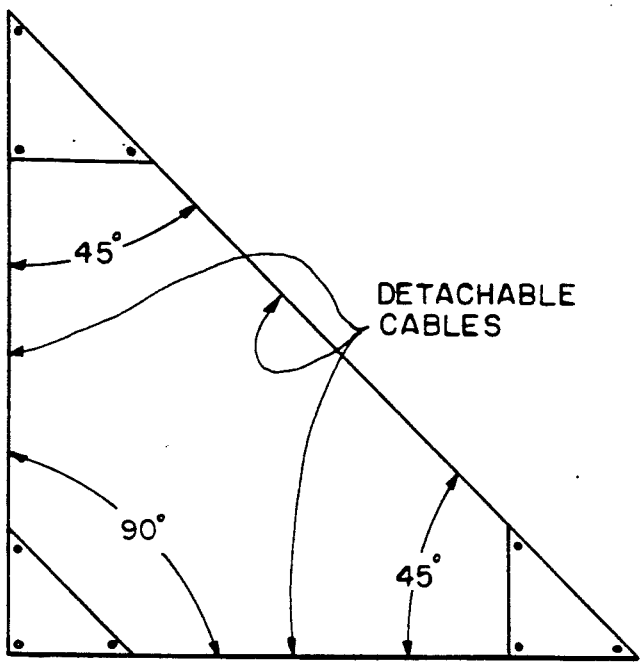
FIG. 3 is a plan view the layout system using the triangular element shown in FIG. 1.
Figure 4:
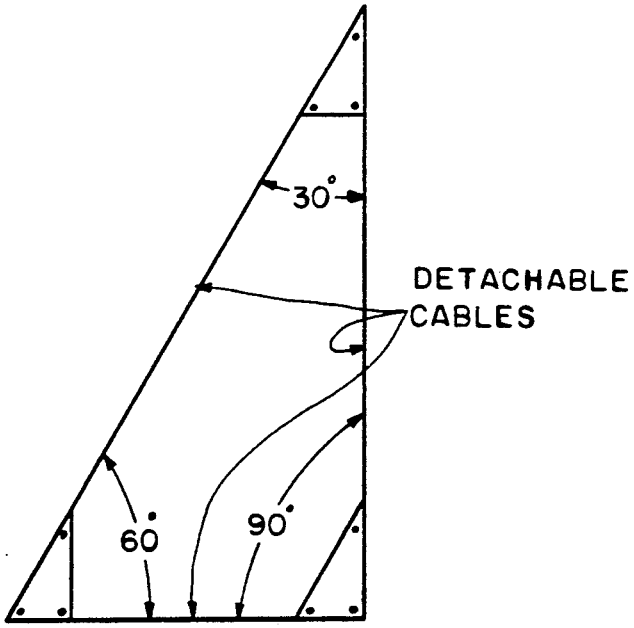
FIG. 4 is a plan view of the layout system using the triangular element shown in FIG. 2.

Shown in FIGS. 1 and 2 are triangular elements 10 and 12 that are used in the system of the present invention. The element 10 is a 45° right triangular element with two 45° angles and two equal sides 14 and 16 connected by a hypotenuse 18. The element 12 is a 30°-60°-90° right triangle with legs 20 and 22 connected by hypotenuse 24. The legs of the triangular elements intersect each other at apexes, such as apex 24 on element 12. Each element further includes a planar web, such as web 26 of triangular element 12 that is surrounded by a wall, such as wall 28 of element 10 and wall 30 of element 12. The walls extend above and below the planar web.

The triangular elements are similar; therefore, only element 12 will be described, with the description being applicable to element 10 as well. The element 12 includes a plurality of anchor accommodating holes through the web. Each anchor accommodating hole has a sleeve 32 extending therethrough. Each sleeve is tubular and extends above and below the web. Each sleeve further includes a lobar portion 34 thereon, with the lobar element located adjacent to an apex. Each triangular element further includes a plurality of female connection element means, such as connection elements 36. Each of the connection elements includes a tubular sleeve extending above and below the web, and has two diametrically opposed slots, such as slot 38 extending longitudinally thereof from an upper rim to the plane of the web. The slots are oriented parallel to an adjacent leg of the triangular element, and serve a purpose that will be understood from the ensuing discussion.

The wall of each triangular element includes a plurality of grooves, such as groove 40 and groove 42. The grooves 40 are oriented at a right angle to the wall, whereas the grooves 42 are oriented at an oblique angle to the wall.

Figure 5:
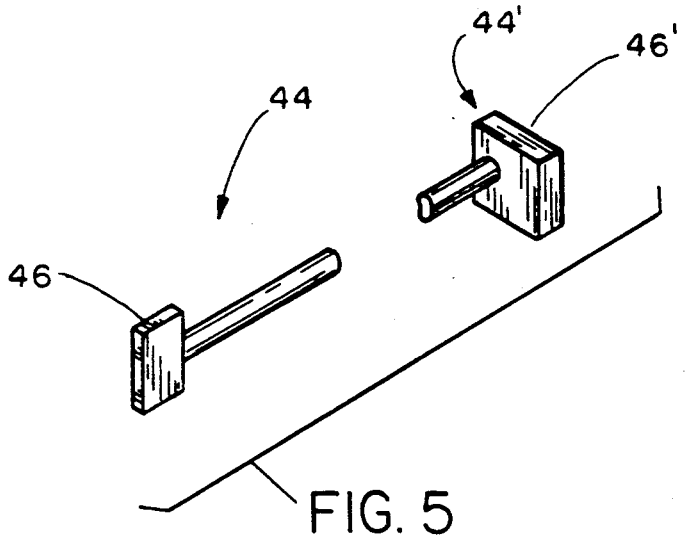
FIG. 5 is a perspective view of a tethering cable used in conjunction with the triangular elements of the present invention.

A tethering cable 44 and a tethering cable 44' are shown in FIG. 5. The cables 44 and 44' are used to connect two triangular elements together, and the overall layout system generally includes three such cables, with two of the cables being equal in length. Each cable includes a male connection element 46 and/or 46' on one or both ends thereof. The male connection elements are releasably connected to the cable, and engage the sleeves 36 and web of each triangular element adjacent to the slots 38. If the male connection element 46 is used, the cables extend through the sleeves 36, and if the connection elements 46' are used, the cables extend through the grooves 40. In either case, two triangular elements are connected via the cables.

An anchor, such as a ground bolt, or the like, is accommodated through the sleeves 32 and anchors the triangular elements to the ground as will be understood from the following discussion.

Figure 6:
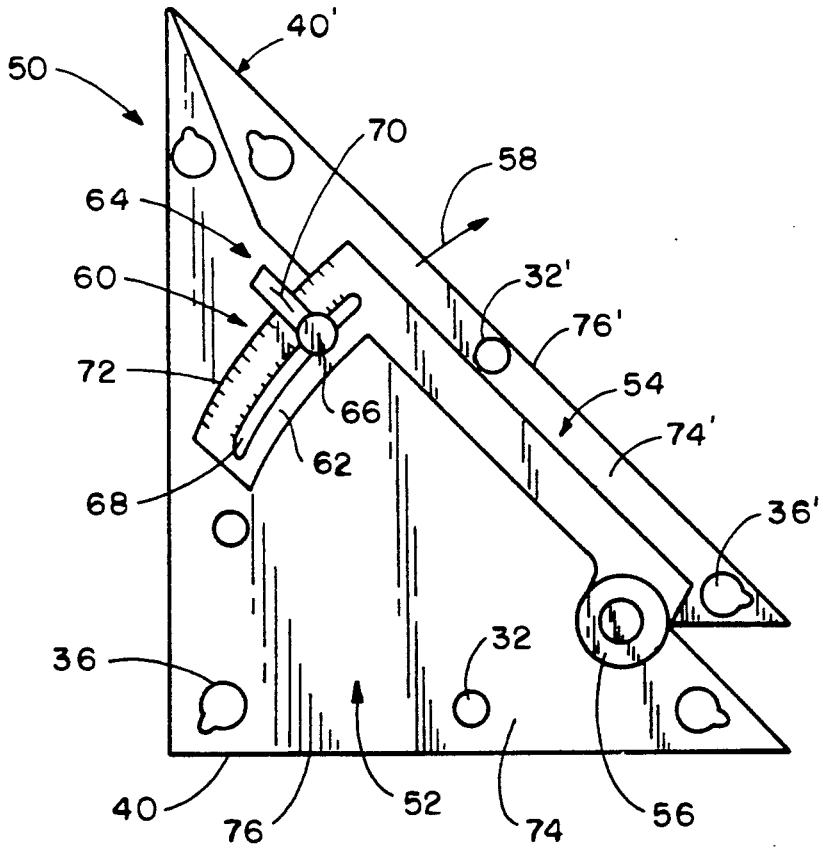
FIG. 6 is a changeable triangular element used in the present invention.

An alternative form of triangular element is shown in FIG. 6 as element 50. The element 50 is also triangular, but is adjustable whereby different angles can be set. Thus, the element 50 includes two sections 52 and 54 that are pivotally connected together by connection 56 so section 54 can move in direction 58 with respect to section 52. An angle indicating mechanism 60 includes a protractor 62 connected to section 54 and a mount 64 mounted on section 52. The mount 64 includes a knob 66 that is mounted on section 52 and extends through arcuate slot 68 in the protractor 62. The knob is tightened down, as by screwing the knob onto a threaded stud that is mounted on the section 52 and which extends through the arcuate slot 68. A marker 70 is located on the mount 64 to be aligned with angle indicating indicia, such as indicia 72 to set the angle of the element 50. Otherwise, element 50 includes a planar web 74 and 74' similar to the webs of the other triangular elements, a wall 76 and 76' similar to wall 28 and grooves 40 and 40' in that wall. Anchor accommodating means 36 and 36' are also included in the element 50, as are tether cable connection elements 32 and 32'. The element 50 is similar to the elements 10 and 12 except for the angularly adjustable feature thereof. The element 50 is thus used in a manner similar to the manner of use for elements 10 and 12.

Figure 10:
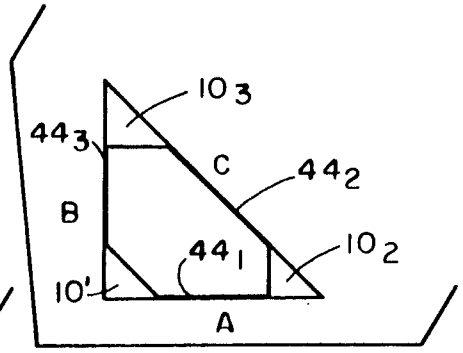
FIGS. 7–13 illustrate a method of laying out a quadrilateral shape using the system of the present invention.
Figure 9:
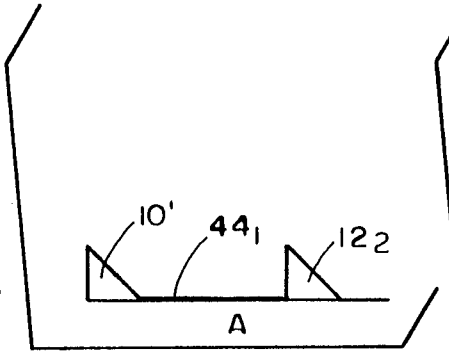
Figure 8:
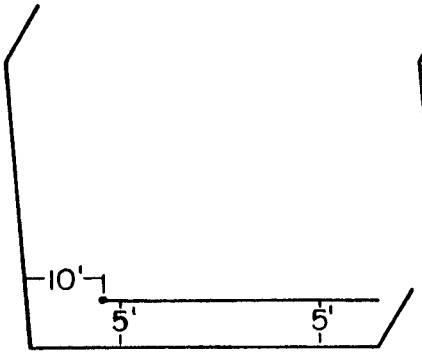
Figure 7:
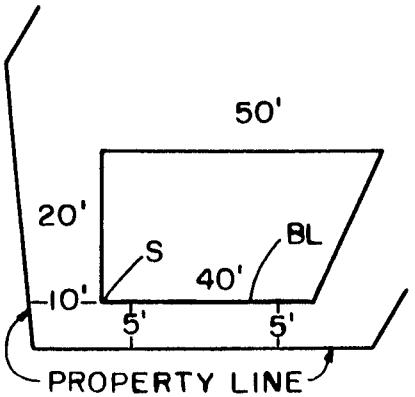
Figure 13:
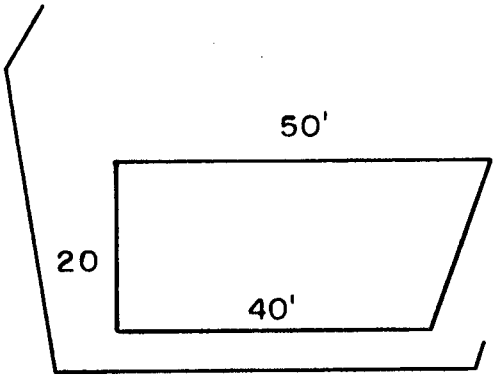
Figure 12:
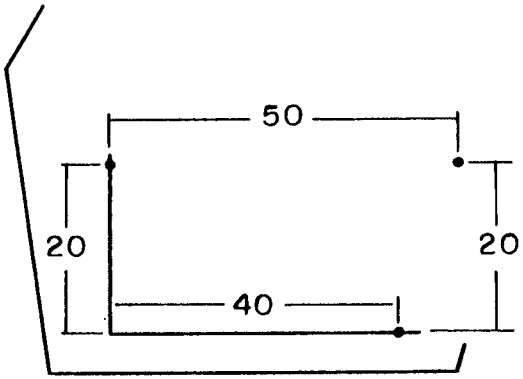
Figure 11:
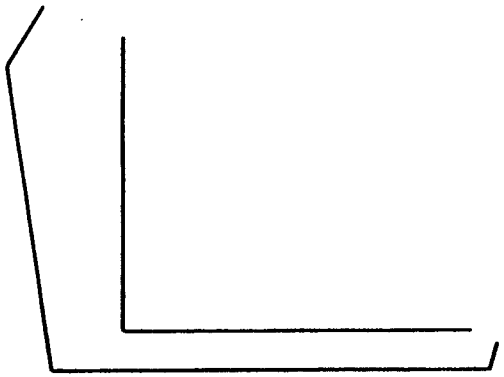
Figure 14:
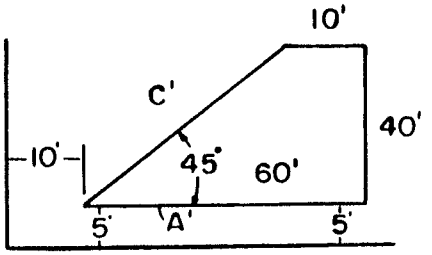
FIGS. 14–23 illustrate a method of laying out a multisided shape using the system of the present invention.
Figure 15:
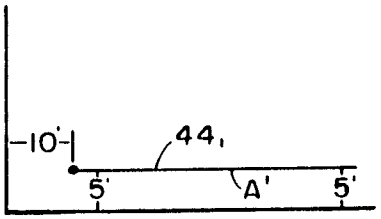
Figure 16:
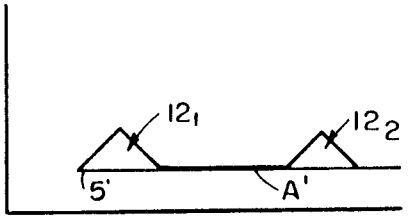
Figure 17:
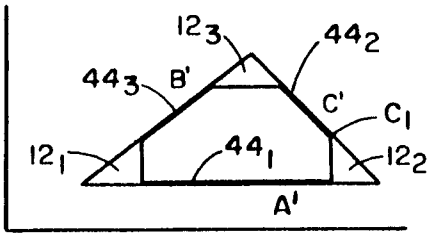
Figure 18:
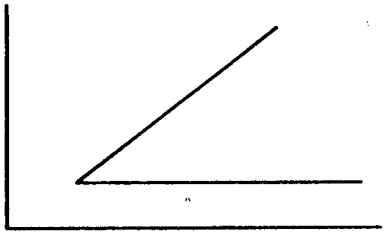
Figure 19:
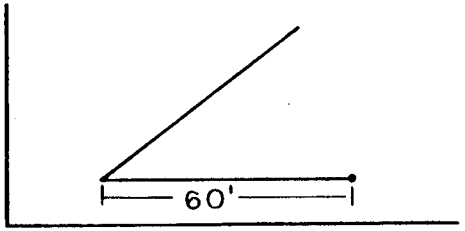
Figure 20:
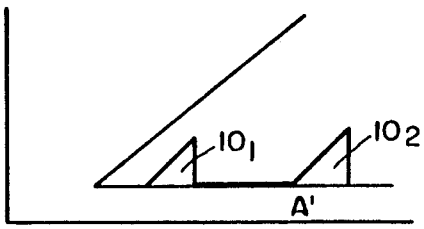
Figure 21:
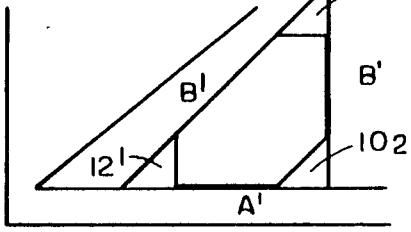
Figure 22:
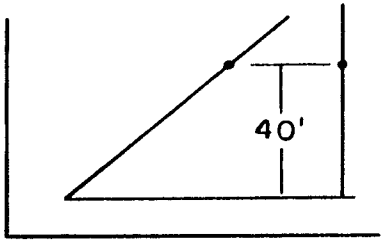
Figure 23:
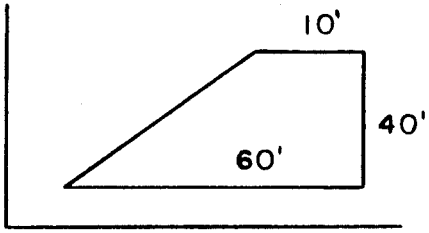

The use of the triangular elements and tethering cables is indicated in FIGS. 7–23. A method of defining a quadrilateral is shown in FIGS. 7–13, and begins with defining a starting point S by measurement from the property line. A baseline BL is defined by measurement from the property line. Since the quadrilateral includes a right angle adjacent to the starting point S, the triangular element 10 is used. A first element $10_1$ is anchored into the ground adjacent to the starting point S to be oriented as shown in FIG. 9, and a first tether cable $44_1$ is attached to the first element and extended along the base line, as indicated at A in FIGS. 9 and 10. The desired length of the base line is measured off on the tethering cable, and a second triangular element $10_2$ is attached to the tethering cable. That second element is anchored into the ground on the base line and located and oriented as indicated in FIGS. 9 and 10. A second tethering cable $44_2$ is attached at one end thereof to the second triangular element, and is extended along the line C. A third triangular element $10_3$ is attached to another end of the cable $44_2$, and a third tethering cable $44_3$ is attached to the elements $10_1$ and $10_3$ and extends along line B. The tethering cables $44_1$ and $44_3$ are equal in length whereby triangle ABC is an isosceles right triangle. The angle between lines A and B will be a right angle due to the geometry of the triangle ABC with the angles between lines B and C and between lines A and C being equal and lines A and B being equal. With lines A and B defined, as shown in FIG. 11, the remaining parts of the overall layout can be defined by simple measurements as indicated in FIGS. 12 and 13 for the measurements indicated. It is noted that the particular measurements and angles shown in FIGS. 7–13 are for example only, and are not intended to be limiting.

Another form of layout is indicated in FIGS. 14–23 as including a 45° angle between lines A' and C'. This angle is defined using triangular element 12 in a manner similar to the just-described procedure. Thus, a first triangular element $12_1$ is positioned at a starting point S' that has been defined by measurement, and a first tethering cable $44_1$ is extended along a baseline A' that has been established by measurement from the property line. A second triangular element $12_2$ is anchored into the ground at the other end of the base line, and the first tethering cable is attached thereto. A second tethering cable $44_2$ is attached at one end thereof to the second triangular element and is extended along line C'. A third triangular element $12_3$ is attached to the second tethering cable and a third tethering cable $44_3$ is attached to the elements $12_1$ and $12_3$, with the cable $44_3$ being equal in length to the cable $44_2$. Either the length of the cables can be set according to the relationship $A^2=B^2+C^2$ with two of the legs, being equal in length, or the angle between lines B' and C' can be set at 90° using the triangular element $12_3$, whereby the angle between lines A' and B' is equal to 45°. The angle and lines thus set are then used for further lines and angles as indicated in FIGS. 20–23. The additional angles are set according to either of the above-described methods as indicated in these FIGS. 20–23. Any final overall layout is defined by simple measurements. The angles can be set using any of the triangular elements 10, 12 or 50, with element 50 being adjusted to set a desired angle.

It is understood that while certain forms of the present invention have been illustrated and described herein, it is not to be limited to the specific forms or arrangements of parts described and shown.

I claim:

1. A layout system comprising:

A) three identical triangular elements, each including
  (1) a wall,
  (2) a planar web spanning said wall,
  (3) a plurality of female connection elements on said web, each female connection element including a tubular sleeve extending through said wall, and having a slot defined therein,
  (4) a plurality of anchor elements on said web, each anchor element including a tubular sleeve extending through said web and having a lobar portion located near an apex of said triangular element,
  (5) a plurality of first grooves defined through said wall at a right angle to said wall, and
  (6) a plurality of second grooves defined through said wall at an oblique angle with respect to said wall; and C) a plurality of tethering cables for attaching one triangular element to another triangular element, each tethering cable including a male connection element on each end thereof, said male connection elements being sized to be received in said female connection element slots, at least two of said plurality of tethering cables being equal in length.

2. The layout system defined in claim 1 wherein each of said walls extends at a right angle to said planar web.

3. The layout system defined in claim 2 wherein said triangular elements are 30°-60°-90° triangles.

4. The layout system defined in claim 2 wherein said triangular elements are 45°-45°-90° triangles.

5. The layout system defined in claim 2 wherein said triangular elements are adjustable triangles.

6. The layout system defined in claim 5 wherein said each of said adjustable triangles includes a first section, a second section, a pivot means connecting said first and second sections together, a protractor element on one of said sections, a marker on the other one of said sections, and a lock element on said second section.

7. A method of laying out a specified area comprising steps of:

A) providing a layout system comprising three identical triangular elements, each including
(1) a wall,
(2) a planar web spanning said wall,
(3) a plurality of female connection elements on said web, each female connection element including a tubular sleeve extending through said wall, and having a slot defined therein,
(4) a plurality of anchor elements on said web, each anchor element including a tubular sleeve extending through said web and having a lobar portion located near an apex of said triangular element,
(5) a plurality of first grooves defined through said wall at a right angle to said wall,
(6) a plurality of second grooves defined through said wall at an oblique angle with respect to said wall,
(7) each of said walls extending at a right angle to said planar web; and a plurality of tethering cables for attaching one triangular element to another triangular element, each tethering cable including a male connection element on each end thereof, said male connection elements being sized to be received in said female connection element slots, at least two of said plurality of tethering cables being equal in length;

B) defining a starting point by measurement;

C) defining a base line by measurement;

D) anchoring a first one of said triangular elements to have an apex thereof adjacent to the starting point;

E) attaching one end of a first one of said tethering cables to said first one of said triangular elements;

F) extending the first one of said tethering cables along the base line;

G) attaching a second one of said triangular elements to another end of the first one of said tethering cables.

anchoring the second one of said triangular elements to have an apex thereof a predetermined distance from the starting point as determined by said measurement step;

I) attaching a first end of a second one of said tethering cables to the second one of said triangular elements;

J) extending the second one of said tethering cables away from the second one of said triangular elements.

K) attaching a third one of said triangular elements to another end of the second one of said tethering cables.

L) attaching one end of a third one of said tethering cables to said third one of said triangular elements and extending said third one of said tethering cables towards the first one of said triangular elements;

M) making the first one of and third one of said tethering cables equal in length;

N) attaching another end of the third one of said tethering cables to the first one of said triangular elements.

8. The method of laying out a specified area defined in claim 7 further including a step of using a first set of triangular elements to define a first angle with respect to the base line, and then using a second set of triangular elements to define a second angle with respect to the base line.

* * * * *